United States Patent [19]

Zucchini

[11] 4,279,456

[45] Jul. 21, 1981

[54] ELECTRIC LINES OF THE ARMOR-PLATED TYPE, DESIGNED ESPECIALLY FOR ELECTRIC SYSTEM FOR INTERIORS

[75] Inventor: Guido Zucchini, Brescia, Italy

[73] Assignee: F. Lli Zucchini, Italy

[21] Appl. No.: 80,117

[22] Filed: Sep. 28, 1979

[30] Foreign Application Priority Data

Oct. 13, 1978 [IT] Italy ..... 5258 A/78
Oct. 13, 1978 [IT] Italy ..... 7085 B/78
Oct. 13, 1978 [IT] Italy ..... 7086 B/78

[51] Int. Cl.[3] ..... H01R 9/00

[52] U.S. Cl. ..... 339/32 R; 339/21 R; 339/22 R; 339/88 R

[58] Field of Search ..... 339/21 R, 22 R, 75 R, 339/75 M, 88, 222, 21 S, 22 B, 22 T, 32 R

[56] References Cited

U.S. PATENT DOCUMENTS 3,686,614 8/1972 Hyrylainen ..... 339/21 R
3,757,273 9/1973 Hesse ..... 339/21 R
3,760,133 9/1973 Howard ..... 339/21 R
3,993,385 11/1976 Seger ..... 339/21 R

FOREIGN PATENT DOCUMENTS 2411976 2/1976 Fed. Rep. of Germany ..... 339/22 R

*Primary Examiner*—John McQuade
*Attorney, Agent, or Firm*—Browdy and Neimark

[57] ABSTRACT

A bipolar shunting device for multipolar electric lines formed by a box-type contact unit which may be fitted slidingly in substantially U-shaped sections, which support internally two opposite sets of electric insulated wires. A box-type connection unit is provided outside of the sections. In the contact unit three moveable contacts are provided, which are operated by a lever control placed outside of the connection unit. The device includes a two-position selecting unit able to connect itself alternately to either of two of the movable contacts while the third contact is constantly connected to the lever control.

3 Claims, 13 Drawing Figures

ELECTRIC LINES OF THE ARMOR-PLATED TYPE, DESIGNED ESPECIALLY FOR ELECTRIC SYSTEM FOR INTERIORS

This invention relates to a bipolar shunting device for multipolar electric lines of the armor-plated type, especially designed for interior lighting systems, said device being made up of a contact box-type part, which may be fitted in a sliding manner into substantially channel-shaped sections, which support on the inside, in an electrically insulated way, two mutually opposed sets of longitudinal wires composing said electric line, and of a box-type connection unit designed to remain external in respect of the above sections.

Presently adopted systems of this type comprise a quadrupole electric line with a shunting device equipped with a pair of contacts on each side, which allow, after insertion into the electric line, permanent connection to the longitudinal electric wires of the line itself, thus leaving to the installer or to the user the task of executing the connections to the output terminals in order to employ either pair of electric wires available for the feed. Hence, such known systems allow the pre-setting of only two electric circuits and furthermore they present the following drawback; they do not allow the passage from one circuit to another unless one alters the connection to the output terminals.

The technical problem which underlies this invention is that of increasing the number of employable electrical circuits, making it furthermore possible to pass from one circuit to the other by simple and fast maneuvres, without having to modify the output connections of the shunting device.

This problem is solved by the bipolar shunting device according to this invention, which is characterized by the fact that it comprises three mobile contacts placed on the same side of the above box-type contact unit and are capable of transverse to and fro shifting due to connection, in the maximum protrusion position, to one of the above mutually faced sets of longitudinal electric wires, each of such sets being made up of three wires, and a lever control, which may be maneuvred from the outside relative to the aforementioned box-type connection unit, due to the simultaneous transversal shifting of two of the above three mobile contacts; a two position selecting unit being interposed between said lever control and said mobile contacts, capable of connecting itself alternately to one or the other of two of the above mobile contacts, while the remaining mobile contact is constantly connected to the aforementioned lever control; such shunting device being suitable for insertion into the above sections in accordance with two positions rotated by 180° in respect of one another for the employment of either of the above two sets of longitudinal electric wires.

One thus has the advantage that for each position of said shunting device, two different electric circuits may be realized, according to the presetting of the above selecting unit, with a total of four available electric circuits, while the passage from one circuit to the other is achieved simply by shifting the selecting unit and inserting, according to either possible position, the shunting device into the electrified rails, without having to carry out alterations on the output connections.

Some further features and advantages of the invention shall appear in the course of the detailed description of some preferred, but not exclusive, embodiments of a bipolar shunting device for a six-pole electric line, which are illustrated by way of example and are in no way limiting, with reference to the enclosed drawings, in which:

FIG. 1 is a cros-section of a six-pole electric line constituting said electrified rail in which the shunting device according to the invention may be fitted (indicated by a dotted line in this Figure);

FIGS. 2 and 3 give a perspective view, of both sides of a shunting device in a first embodiment of the invention;

Figure 6:
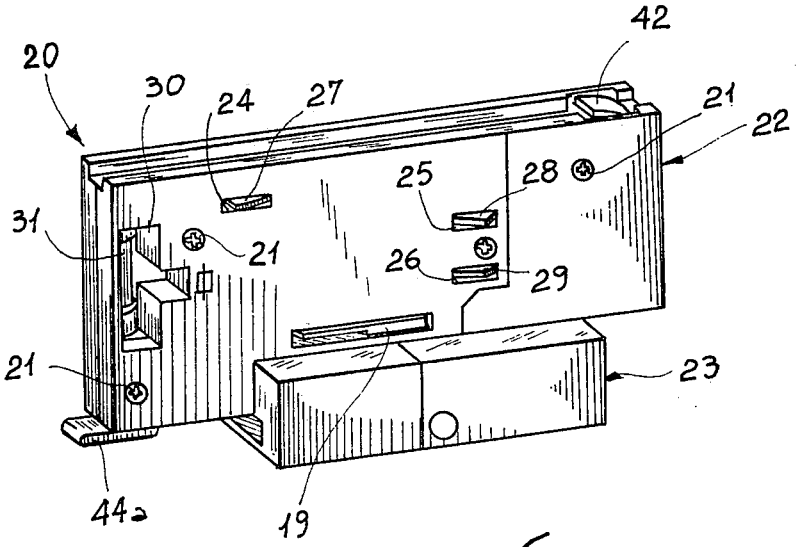
Figure 7:
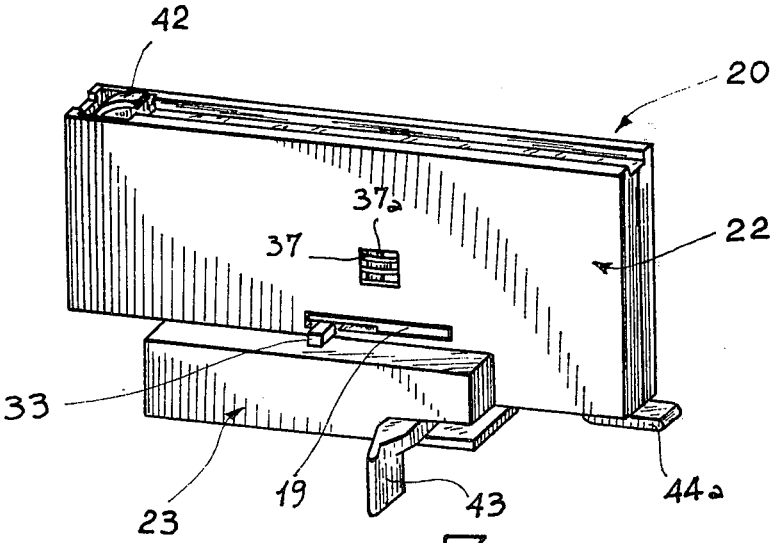
Figure 8:
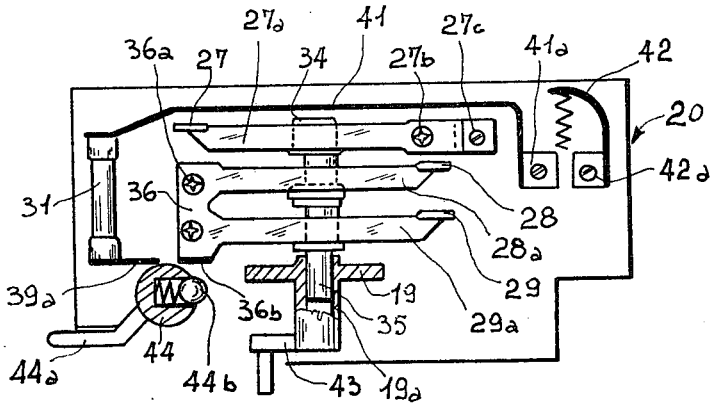
Figure 9:
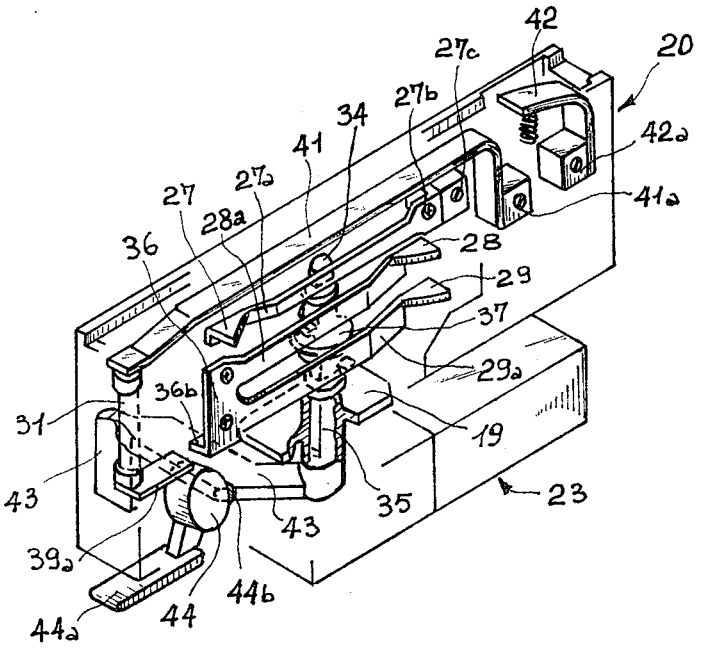
Figure 10:
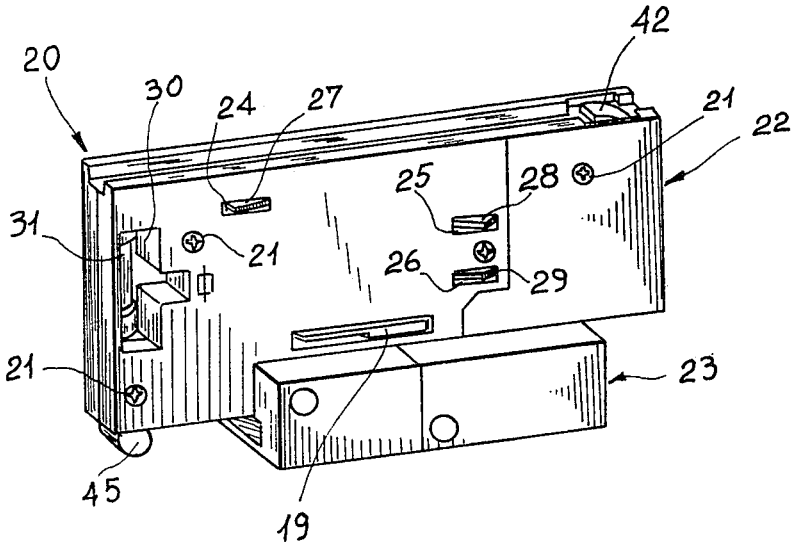
Figure 11:
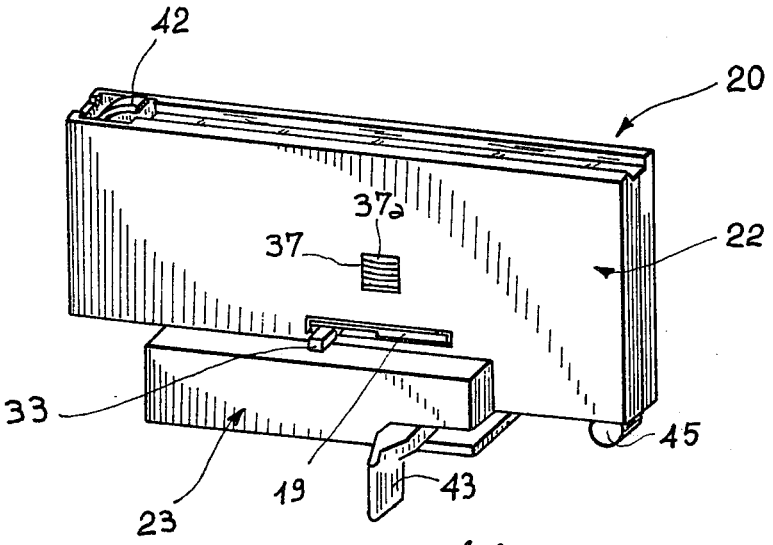
Figure 12:
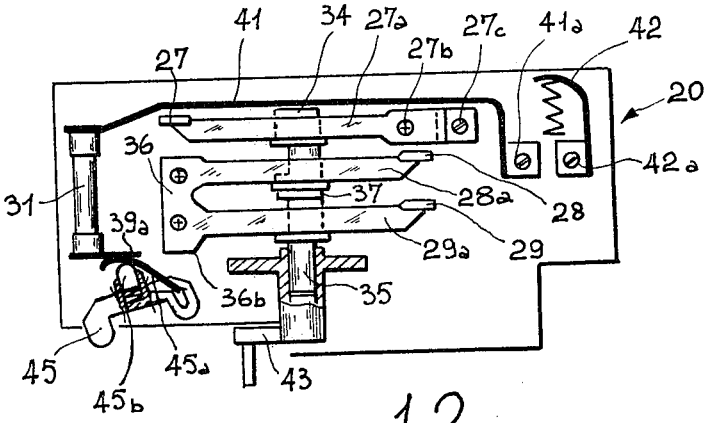
Figure 13:
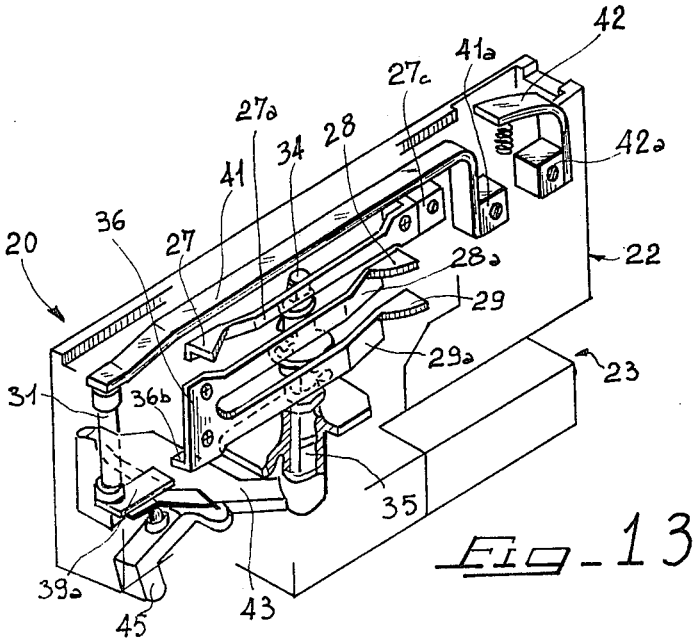

FIGS. 6 and 7 give a perspective view, on both sides, of a shunting device in a second embodiment of the invention;

FIG. 8 is a schematic longitudinal section of the shunting device mentioned under FIGS. 6 and 7;

FIG. 9 is a perspective view of the shunting device mentioned under FIGS. 6 to 8, partially cutaway;

FIGS. 10 and 11 give a perspective view, on both sides, of a shunting device in a third embodiment of the invention;

FIG. 12 is a schematic longitudinal section of the shunting device mentioned under FIGS. 10 and 11;

FIG. 13 is a perspective view of the shunting device mentioned under FIGS. 10 to 12, partially cutaway.

Figure 1:
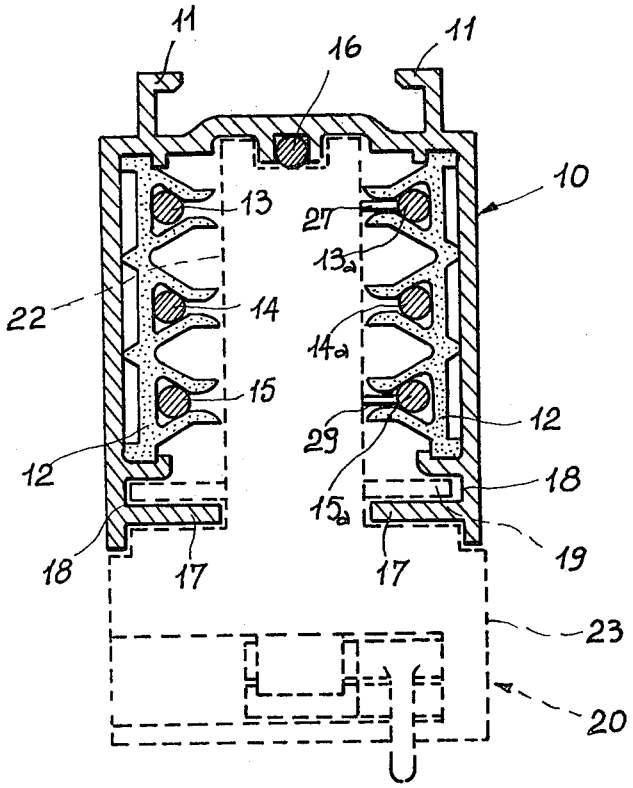
Figure 2:
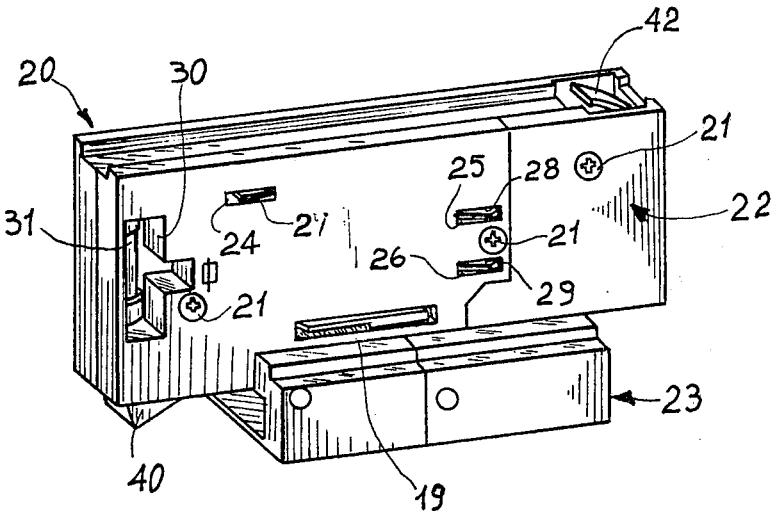

FIG. 1's cross-section shows a six-pole electric line of the armor-plated type, which is supported by a channel-shaped anodized alluminium section 10. Said section exhibits in the centre some external protrusions 11 for its fixing, e.g. to the ceiling, in the rooms where it is employed, and some internal seats, relative to the lateral sections, for restrained fixing of strip-shaped components 12 made of dielectric material, for instance polyvinyl chloride, which in turn are equipped with housing seats for longitudinal electric wires. More precisely, provision is made for a set of three electric wires 13, 14, 15, inserted into one of the above dielectric components 12, and for another set of three wires 13*a*, 14*a*, 15*a*, fitted into the other dielectric component 12, said sets being mutually opposed in such a way that the longitudinal wires are aligned in pairs. The above wires are made of circular section copper and are fixed in component 12 so as to be accessable only by way of slots positioned inwardly and exhibited by the aforementioned component 12. A ground wire 16, made of circular section tinned copper as well, is then fixed in a respective median seat, produced, inwardly, in the central section of structural shape 10.

In the open part, section 10 exhibits also two opposed edges 17 which limit two opposed internal longitudinal grooves 18, in which a clamping component 19 is fitted, the latter being built onto the shunting device, marked in its entirety by 20.

FIGS. 2 to 5 show a first embodiment of the shunting device. With reference to the latter figures, the shunting device comprises an envelope made of electrically insulating plastic material, preferably of the type known by the trade-mark "NORYL", made up of a number of units which may be secured to each other by means of screws 21. After the assembly, the shunting device appears to be made up of a box-type contact unit 22 having the shape of an oblate parallelepipedon, which may be made to slide within section 10, between insulating components 12, and of a box-type connection unit 23, which is parallelepipedon shaped too, arranged at right angles in respect of the above unit 22 and designed to remain on the outside of section 10, as pointed out by the dots in FIG. 1.

On one side of the box-type contact unit 22 (FIG. 2) provision is made for three little windows 24, 25, 26 which are faced with three respective mobile contacts, substantially triangular in shape, marked by 27, 28, 29, designed to establish the electric connection with the longitudinal wires 13, 14, 15, 13*a*, 14*a*, 15*a*, as will be pointed out later. The same side is furthermore endowed with an inspection window 30 of fuse 31, while on both sides a slot is produced for the output of the ends of the clamping component 19. The latter is butterfly shaped and is integral with coupling 19*a* (FIG. 4) which, in turn, is integral with operating lever 19*b* placed at the level of box-type unit 23 and accessable from the outside.

Coupling 19*a* rotates around a vertical axis 32 (FIG. 4), while lever 19*b* is set horizontally. When device 20 is extracted from the six-pole line 10, however, the motion of clamping component 19 is locked by a safety stake 33 (FIG. 3) which is pushed up by a respective fly spring (not visible in the drawing), said stake being placed in unit 23 in the proximity of component 19; when the device is connected to line 10, on the other hand, said stake 33 is pushed down by the lower edges 17 of the section, therefore, operating lever 19*b*, is possible to rotate component 19 by 90° in order to fit its ends into grooves 18, in the locked position (FIG. 1), thus determining the locking of the device to the electric line. Said rotation occurs from left to right with reference to FIG. 3, starting from the unlocking position shown in the above figure.

Figure 4:
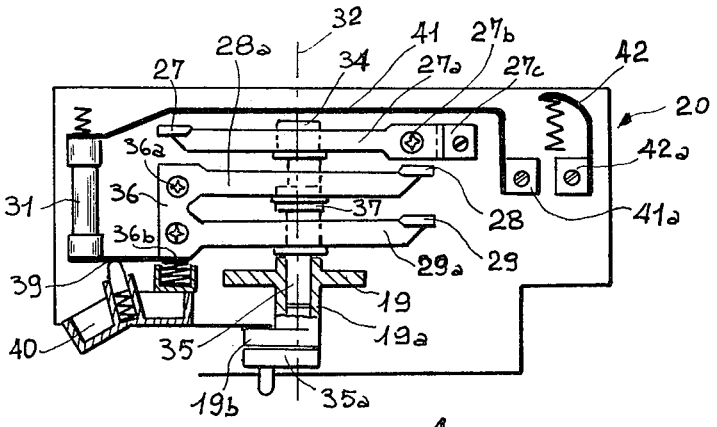
FIG. 4 is a schematic longitudinal section of the shunting device mentioned under FIGS. 2 and 3.
Figure 5:
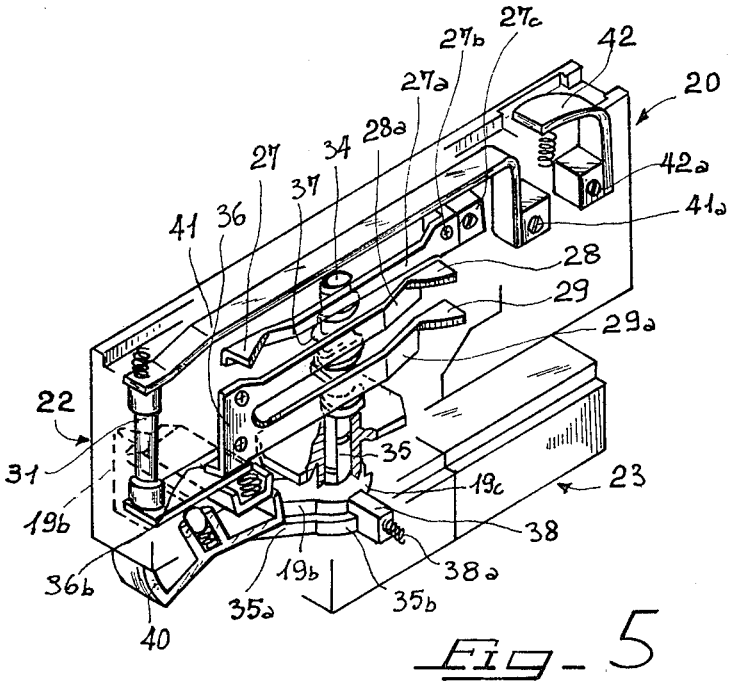
FIG. 5 is a perspective view of the shunting device mentioned under FIGS. 2 and 4, partially cutaway.

As pointed out clearly in FIGS. 4 and 5, contact 27 is made up of a terminal fold of an elastic metal foil 27*a*, fastened to the envelope, at the opposite end, by means of a screw 27*b* and integral with a clamp 27*c*. Said foil 27*a* is constantly connected to a respective cam 34 made of insulating material and integral with the top end of a vertical shaft 35 which passes, with a rotational motion, through coupling 19*a* and integral, at the bottom, with an operating lever 35*a* arranged horizontally next to lever 19*b*. By operating lever 35*a* it is possible to shift foil 27*a* transversally (by means of cam 34) so as to force contact 27 to protrude from the respective window 24, in the phase of electric connection, as will be pointed out more clearly in the following description.

Similarly, contacts 28 and 29 are constituted by terminal folds of branches 28*a*, 29*a* of an elastic metal foil 36, which is U-shaped and secured to the envelope by means of screws 36*a*. The two branches 28*a* and 29*a* are connected to a selecting unit designed to determine the transverse shifting of only one of them, alternately.

The above selecting unit comprises a double cam 37 made of insulating material, produced in an axially to and fro sliding coupling on a prismatic section of vertical shaft 35, so that it can be released upward, to a first position, to connect itself to branch 28*a*, or downward, to a second position, to connect itself to branch 29*a*. The axial shifting of the double cam 37 is possible by means of a tool or simply with a finger nail, through a little window 37*a* (FIG. 3) placed on one side of the envelope. The rotation of the double cam 37 around axis 32 takes place by operating lever 35*a* integral with shaft 35 the double cam 37 being connected to the shaft itself in the direction of rotation; hence, by rotating shaft 35 one produces the transversal shifting of either branch 28*a* or branch 29*a* (according to the position of the double cam 37) and, simultaneously that of foil 27*a*, by means of cam 34.

The shifting of lever 35*a*, is, however, possible only after having moved lever 19*b* to its locking position. In view of the foregoing, lever 35*a* is integral with a cam 35*b* (FIG. 5) endowed with a notch into which, when the circuit is open, a block 38 is fitted which is capable of moving radially and is pushed toward the above cam by a respective fly spring 38*a*; said block 38 is connected to another cam 19*c* as well, which is integral with lever 19*b*: when the latter is shifted to the locking position, cam 19*c* shifts block 38 outwards thus releasing cam 35*b* and allowing the subsequent shifting of lever 35*a*. It is thus possible to ensure that the electric contact occurs after the mechanical locking of the device in respect of the line.

Another block (which is not visible in the figures), placed symmetrically in respect of block 38, has then the task of locking lever 19*b* when lever 35*a* has reached the electric contact position, so that the mechanical unlocking cannot occur before the reversal of lever 35*a* to the initial position of electric disconnection.

Moreover, on that portion of foil 36 from which the two branches 28*a*, 29*a* branch off, provision is made for a 90° fold 36*b* next to which one finds an end of an elastic metal blade 39 the other end of which, it being fixed to the envelope, is connected to fuse 31. It is to be noted that said blade 39 is elastically in constant contact with the aforementioned fold 36*b*. Appropriate markings may be affixed onto the envelope, e.g. O and F, respectively in order to indicate the disconnected and connected positions of lever 40.

The position of lever 40 is such as to prevent the shifting of levers 19*b*, 35*a*, when said lever 40 is in the electric connection position, so as to determine further safety in the maneuvers. The lever 40 has no connecting function; it is provided to prevent the shifting of the lever controls 19*b* and 35*a*. When the lever 40 is in the position shown in FIGS. 4 and 5, the levers 19*b* and 35*a* can be freely rotated at a 90° degree angle. When the lever 40 is in its other position (not shown in the figures), the lever controls 19*b* and 35*a*, cannot be rotated because the right end of the lever 40 (with reference to FIGS. 4 and 5) protudes downwardly and prevents the rotation of these levers. Substantially the lever 40 is nothing more than a safety device.

Besides with blade 39, fuse 31 is in contact with the end of a metal foil 41 as well, the other end of which is integral with a respective clamp 41*a*.

Furthermore, 42 has been adopted to mark a sprung ground contact bound to be in constant contact with ground wire 16, when device 20 is connected to the electric line; said contact 42 is integral with a respective clamp 42*a*.

From the foregoing, the functioning of the abovementioned device appears to be obvious.

The connection of device 20 to line 10 may take place in two positions, at a 180° rotation in respect of one another. In a first position it is possible to connect contacts 27, 28, 29 to longitudinal wires 13, 14, 15, while in the other position the same contacts may be connected to the other set of longitudinal wires 13*a*, 14*a*, 15*a*. In each of such positions, the condition relative to longitudinal wires 13, 13*a* (constituting the neutral wire of the system) and to ground wire 16 being unchangeable, it is possible to choose between connection to wires 14 and 14*a* and connection to wires 15 and 15*a*, so as to achieve a total of four contact combinations.

The choice between wires 14 and 14*a* or between wires 15 and 15*a* is carried out by means of the selecting unit, namely by shifting the aforementioned double cam 37 upwards or downwards, before the connection of device 20 to line 10.

The electric connections to the utilizing equipment are realized by passing the electric cables (not shown) through connection unit 23 (endowed on its bottom with a hole for the passage of said cables) and connecting their ends to clamps 27*c*, 41*a*, 42*a*.

Figure 3:
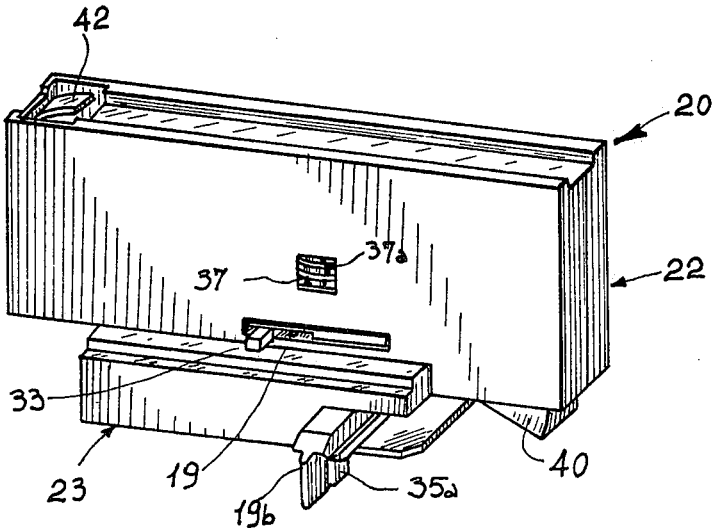

Let us assume we want to employ longitudinal wires 13*a*, 14*a*, 15*a*: device 20 is to be fitted into the line with wires 27, 28, 29 facing said wires, while levers 19*b* and 35*a* are in their resting position shown in FIG. 3. In such phase, contacts 27, 28, 29 are in a withdrawn position in respect of the corresponding little windows 24, 25, 26, and similarly, component 19 is recessed in contact unit 22, hence contact unit 22 itself may be easily fitted between insulating components 12 supporting the longitudinal wires. The fixing of the device in the desired point of the line is obtained by rotating lever 19*b* by 90°, from left to right with reference to FIG. 3, said rotation being possible since stake 33 remains recessed within unit 23 thanks to the jutting point with one of the edges 17 of section 10. One thus obtains the fitting of the ends of component 19 into the inside grooves (FIG. 1) with the consequent locking of device 20 in respect of the electric line.

The rotation of lever 19*b*, furthermore, determines the unlocking of lever 35*a* which, in its previous condition, was locked by block 38 controlled by cam 19*c*. It is then possible to shift by 90° lever 35*a* too, in the same direction as lever 19*b*, in order to determine the electric connection to the longitudinal wires. In fact, by shifting lever 35*a* from left to right, starting from the position shown in FIG. 3, one produces an analogous motion of cam 34 secured to the top of shaft 35 with the subsequent transversal shifting of foil 27*a* so as to make contact 27 protrude from slot 24, until said contact, passing through the respective slot present in the adjacent insulating component 12, reaches wire 13*a*, *as shown in FIG. 1. Thus, electric connection between clamp 27c* and neutral wire 13*a* is established.

With shaft 35 also double cam 37 rotates (it being assembled on said shaft with the possibility of sliding axially, but connected to the shaft in the same rotational direction), which hence produces a transversal shifting of one of the two foils 28*a*, 29*a*. More precisely, if the double cam had been previously set in the lower position, foil 29*a* will be shifted and therefore contact 29 will be made to protrude through window 26 up to the point of connection to wire 15*a*, as shown in FIG. 1. Vice-versa, if double cam 37 ha been pre-set in the top position, foil 28*a* will be shifted and consequently contact 28 will protrude through the respective window 25 until it reaches connection to wire 14*a*. Therefore, the alternative solution will be the electric connection between clamp 41*a* and wire 15*a* or between the above clamp and wire 14*a*, provided lever 40 has been brought to its closing position. In any case clamp 42*a* is electrically connected to ground wire 16.

In order to vary the contact combination, one first returns lever 35*a* back to the starting position, after which one can rotate lever 19*b* (now unlocked) back to the initial position as well (FIG. 3). At this point device 20 may be extracted from the line in order to obtain a different selection, e.g. shifting double cam 37 upward, if the latter had previously been shifted downward. Once this has been done device 20 is connected again, with the same orientation, to the line, hence one rotates levers 19*b* and 35*a*, in that order, once again from left to right as described above.

If on the other hand one wants to employ wires 13, 14, 15, after the desired selection, device 20 is connected to the line with a rotation of 180° in respect of the previous position, so that contacts 27, 28, 29 are facing the latter wires.

Thus, without altering the connection of the cables to clamps 27*c*, 41*a*, 42*a*, it is possible to connect in pairs all the six wires composing the system, allowing four different contact combinations. As pointed out, the motion of levers 19*b*, 35*a* may take place only if one follows a certain sequence. More precisely, in the connection maneuvre, one must first carry out the mechanical locking operation (lever 19*b*) and then the electric contact (lever 35*a*), while in the disconnection maneuvre, one must first carry out the electric disconnection (lever 35*a*) and then the mechanical unlocking (lever 19*b*). Furthermore, the special position of lever 40 allows the execution of the connection and extraction operations only when the lever 40 is in the open position.

The device according to the invention is therefore in full compliance with the most rigorous rules and regulations governing safety and the prevention of accidents at work which are presently in force.

FIGS. 6 to 9 illustrate a second embodiment of the device according to the invention, in which many of the components are like those pertaining to the first embodiment described above, hence the same numerical references used above will be adopted for the unchanged components.

Instead of the aforementioned two operating levers 19*b* and 35*a*, relative to the first embodiment, this second embodiment exhibits a single operating lever 43 which is made integral with both coupling 19*a*, bearing locking component 19, and shaft 35 bearing upper cam 34 and double cam 37. Just like in the previous case, cam 34 is integral with shaft 35, while double cam 37 may be shifted axially along said shaft but is connected to same in the direction of rotation.

Hence, with the shifting of the single operating lever 43 one obtains, in one direction, the mechanical locking and the electric contact, and in the other direction, the mechanical unlocking and the electric disconnection.

The electric contacts remain unchanged in respect of the ones described above, while provision is made for a switch. The latter comprises a cylindrical block 44, made of electrically insulating material, rotating within a respective housing seat which the envelope presents internally; said block is integral with an operating lever 44*a* which, when at rest, is in contact with unit 22 of the device, while a little metal ball 44*b* is partially inserted into the above block, and is pushed towards the outside by a respective fly spring (FIG. 8). When lever 44*a* is rotated downward by 90° in respect of the position shown in FIG. 8, the aforementioned little ball 44*b* closes the circuit connecting bend 36*b* of foil 36 to stiff blade 39*a* in contact with fuse 31 (said blade substitutes elastic blade 39 relating to the first embodiment described above). When the switch is in the making position, namely when lever 44*a* is pushed down, the lever itself prevents the rotation of lever 43 which, in such conditions, cannot be shifted from its position at rest (FIG. 7) to the operating position, characterized by a 90° rotation. Therefore, such a shift may take place only when lever 44*a* is in its opening position, namely in contact with the bottom side of unit 22, as indicated in FIGS. 6 to 9, a feature which prevents the occurrence of false moves when wires are live.

As far as all other features are concerned, the device illustrated in these last Figures is identical to that of the first embodiment described previously and the functioning is analogous too. Shifting double cam 37 axially and rotating the device by 180°, four different contact combinations are again possible.

The third embodiment, illustrated in FIGS. 10 to 13, is similar to the one illustrated with reference to FIGS. 6 to 9, with the only exception relating to the different structuration of the switch. While the same numerical references have been maintained for the structural components which have not been changed, the switch suited to fit the third embodiment comprises an equalizer 45 made of electrically insulating material, on which an elastic metal foil 45*a* is assembled, which is pushed up by a little piston 45*b* (FIG. 12) connected to a fly spring.

In the open condition (FIG. 12), the rounded top end of foil 45*a* is in contact with stiff lamina 39*a* (in contact with fuse 31) but remains at a distance from flap 36*b* of lamina 36, thus disconnecting the circuit. In this condition, the slant of equalizer 45 allows the shifting of operating lever 43.

If equalizer 45 is shifted over to the other position, lamina 45*a* establishes the contact between lamina 39*a* and flap 36*b* of lamina 36, thus making the circuit. In the latter position, the equalizer 45 protrudes downwards near lever 43 stopping its free rotation.

As far as the functioning is concerned there are no changes in respect of the device described with reference to FIGS. 6 to 9.

As may be noted, the device according to the invention, in any of the embodiments described above, allows easy selection of the contact combinations, such object requiring only the 180° rotation of the device itself when it is connected to the line and/or the previous shifting of the selecting unit (component 37). A further advantage is supplied by the possibility of inspecting fuse 31 directly as well as the possibility to change same, through slot 30, without having to open up.

Naturally, the invention is not limited just to the described embodiments, but several alterations and variations belonging to the field of the inventive idea are possible.

I claim:

1. In a bipolar shunting device for multipolar electric lines of the armor-plated type, designed especially for electric systems for interior lighting, the device being of the type having a box-shaped contact unit, which may be fitted slidingly in substantially channel-shaped sections, which support internally, in an electrically insulated way, two opposite sets of longitudinal electric wires constituting the multipolar electric lines, and including a box-shaped connection unit designed to remain on the outside of the sections, and a clamping component, substantially of butterfly shape, for locking the device to the multipolar electric lines, the improvement comprising, on a same side of said box-shaped contact unit, an elastic metal blade (27*a*) integral, at one end with a clamp (27*c*) and carrying, at its other end, a contact (27) defined by a terminal fold of said elastic metal blade (27*a*) and a U-shaped elastic metal foil (36) formed by two branches (28*a*, 29*b*) carrying, at their ends, contacts (28, 29) defined respectively by respective terminal folds of said branches, said U-shaped elastic metal foil (36) being electrically connected to a respective clamp (41*a*) through a fuse (31) placed in correspondence with an inspection window (30) in said box-shaped contact unit, the device further including a first lever control (35*a*) for the displacement of said contacts (27, 28, 29) from a position wherein they are inside said box-shaped contact unit to a position wherein they protrude sideways from said box-shaped contact unit and a separate lever control (19*b*) for shifting said clamping component (19).

2. An improved device according to claim 1, wherein said first and said separate lever controls (35*a*, 19*b*) are integral with respective cams (35*b*, 19*c*) which cooperate with check unit (38), in order to determine in connection phase, locking of said first lever control (35*a*) for shifting of said contacts (27, 28, 29) until said separate lever control (19*b*) has reached locking position and, in disconnection phase, locking of said separate lever control (19*b*) until said first lever control (35*a*) has reached an electric disconnection position.

3. An improved device according to either claim 1 or claim 2, wherein said channel-shaped sections are provided with longitudinal, internal grooves (18), said clamping component (19) fitting, in locking position, into said grooves.

* * * * *